US011725450B2

(12) United States Patent
Belding

(10) Patent No.: US 11,725,450 B2
(45) Date of Patent: Aug. 15, 2023

(54) FIRE EXIT SYSTEM

(71) Applicant: Abigail Belding, Colchester, CT (US)

(72) Inventor: Abigail Belding, Colchester, CT (US)

( * ) Notice: Subject to any disclaimer, the term of this patent is extended or adjusted under 35 U.S.C. 154(b) by 661 days.

(21) Appl. No.: 16/804,741

(22) Filed: Feb. 28, 2020

(65) Prior Publication Data

US 2021/0270080 A1 Sep. 2, 2021

(51) Int. Cl.

| | |
|---|---|
| ***E05F 15/00*** | (2015.01) |
| ***E05F 15/72*** | (2015.01) |
| ***E05F 15/77*** | (2015.01) |
| ***E05F 15/79*** | (2015.01) |
| *E06C 1/56* | (2006.01) |
| *A62B 1/06* | (2006.01) |
| *E06C 9/14* | (2006.01) |

(52) U.S. Cl.

CPC ..... *E05F 15/72* (2015.01); *E05F 15/77* (2015.01); *E05F 15/79* (2015.01); *A62B 1/06* (2013.01); *E06C 1/56* (2013.01); *E06C 9/14* (2013.01)

(58) Field of Classification Search

CPC . E05F 15/72; E05F 15/77; E05F 15/79; E05F 15/665; E05Y 2201/684; E05Y 2800/28; E05Y 2201/652; E05Y 2900/55; A62B 1/06; E06C 1/56; E06C 9/14

USPC ..... 49/360

See application file for complete search history.

(56) References Cited

U.S. PATENT DOCUMENTS 860,518 A * 7/1907 Best ..... E05F 15/689 16/194
906,749 A * 12/1908 Strong ..... E05F 17/00 49/98
1,176,148 A * 3/1916 Keen ..... H04N 1/00204 358/400
1,590,473 A * 6/1926 Miller ..... E05F 15/665 49/118
2,135,207 A * 11/1938 Bramer ..... G09F 11/32 40/476
2,755,083 A * 7/1956 Renaud ..... E05D 13/06 49/289
4,237,654 A * 12/1980 Landem ..... A62C 2/247 49/164
5,144,770 A * 9/1992 Kraus ..... E05F 11/40 49/362
5,373,605 A * 12/1994 Austin ..... B60S 1/20 15/250.24

(Continued)

FOREIGN PATENT DOCUMENTS

DE 202006012861 U1 * 11/2006 ..... E05D 15/165
WO WO-0121926 A1 * 3/2001 ..... B63B 27/14
WO WO-02064936 A2 * 8/2002 ..... E05F 15/665

OTHER PUBLICATIONS

Video: Abigail Belding, "The EZ Exit", https://www.youtube.com/watch?v=IXCYRIZGfXM&app=desktop, posted May 13, 2019 (1 page).

*Primary Examiner* — Jerry E Redman

(74) *Attorney, Agent, or Firm* — Wilmer Cutler Pickering Hale and Dorr LLP

(57) ABSTRACT

A fire exit system is disclosed. In one particular embodiment, the fire exit system may include a motor mechanically coupled to a window such that the motor, when turned on, causes the window to open, a controller coupled to the motor, and a switch coupled to the controller. When the switch is activated, the controller is configured to turn on the motor to open the window.

18 Claims, 7 Drawing Sheets

(56) References Cited

U.S. PATENT DOCUMENTS

| | | | | | |
|---|---|---|---|---|---|
| 5,440,837 | A * | 8/1995 | Piltingsrud | E05D 15/22 | 74/625 |
| 5,502,925 | A * | 4/1996 | Gorrell | E05D 13/1207 | 49/449 |
| 5,595,026 | A * | 1/1997 | Licking | E05F 15/57 | 49/360 |
| 5,605,013 | A * | 2/1997 | Hogston | E05F 15/71 | 49/362 |
| 5,784,831 | A * | 7/1998 | Licking | E05B 51/02 | 49/141 |
| 5,839,230 | A * | 11/1998 | Licking | E05F 15/57 | 49/141 |
| 5,860,371 | A * | 1/1999 | Shelley | E05G 7/004 | 109/15 |
| 6,148,700 | A * | 11/2000 | Upholz | B25B 27/302 | 81/486 |
| 9,038,317 | B2 * | 5/2015 | Hansen | E05F 15/665 | 49/360 |
| 9,797,182 | B2 * | 10/2017 | Raap | E05F 15/665 | |
| 10,253,543 | B2 * | 4/2019 | Newman | E05F 11/40 | |
| 10,370,887 | B2 * | 8/2019 | Lange | E05D 13/1207 | |
| 10,704,314 | B2 * | 7/2020 | Valverde | G08B 25/10 | |
| 11,072,967 | B2 * | 7/2021 | Benkreira | F41H 5/0492 | |
| 2003/0110697 | A1 * | 6/2003 | Perron | E05F 11/36 | 49/123 |
| 2006/0158339 | A1 * | 7/2006 | Brundula | E05F 15/79 | 340/5.71 |
| 2012/0160606 | A1 * | 6/2012 | Barbara | E06B 7/28 | 182/93 |
| 2019/0112860 | A1 * | 4/2019 | Urban | E05F 15/73 | |
| 2021/0270080 | A1 * | 9/2021 | Belding | E05F 15/77 | |

* cited by examiner

FIRE EXIT SYSTEM

FIELD OF THE DISCLOSURE

The present disclosure relates generally to safety exit systems and, more particularly, to a fire exit system that may allow people of all ages to safely exit within a few minutes a house that is engulfed in flames.

BACKGROUND OF THE DISCLOSURE

Every year, there are more than 3,000 deaths and 14,000 injuries related to house fires in the United States. These injuries and fatalities result from around 1.4 million house fires in a year. FIG. 1 illustrates a decreasing trend in fire-related injuries over the years, potentially due to a combination of factors including better safety features. However, this decreasing trend may also be because of the increasing trend in fire-related deaths as illustrated in FIG. 2. FIG. 3 illustrates yearly fire-related fatalities by age. Based on FIG. 3, it may be deduced that people who are 65 years of age or older have the highest likelihood of dying in a house fire, which is likely due to their physical limitations. Fourteen-year-old and younger children are also vulnerable and typically rely on other people—because they are not strong and/or tall enough to open windows—to help them escape fires. Regardless of age, FIG. 3 suggests that fires represent a threat to people of all ages.

House fires are daunting. A small flame can turn into a major fire in less than 30 seconds. It only takes minutes for a thick black smoke to fill a house or for the house to be engulfed in flames. In just two minutes, a fire can become life-threatening. In five minutes, a residence may be engulfed in flames and exits may be blocked. Heat from the flames is more threatening than the flames themselves. Room temperatures in a fire can be 100 degrees Fahrenheit at floor level and rise to 600 degrees Fahrenheit at eye level. Inhaling this hot air may scorch the human lungs, and the heat may melt clothes to the skin. Smoke and toxic gases kill more people than flames do. Fire produces poisonous gases that make people disoriented and drowsy. Asphyxiation is the leading cause of fire deaths, exceeding burns by a three-to-one ratio. Moreover, fires start bright, but quickly produce black smoke and complete darkness.

A test by the Underwriter Laboratories—a not-for-profit product safety testing and certification organization—has shown that an average-sized room furnished with modern products takes three minutes to be fully engulfed in flames. The same room furnished with 50-year old items would take 30 minutes to be fully engulfed in flames. Thus, unlike decades ago, people today have only a few minutes to get out of a house in case of a fire emergency. Speed and ease of escaping a fire are of essence, no matter a person's age.

In view of the foregoing, it may be understood that there is need for a fire exit system that allow people of all ages to safely exit within a few minutes a house that is engulfed in flames.

SUMMARY OF THE DISCLOSURE

A fire exit system is disclosed. In one particular embodiment, the fire exit system may include a motor mechanically coupled to a window such that the motor, when turned on, causes the window to open, a controller coupled to the motor, and a switch coupled to the controller. When the switch is activated, the controller is configured to turn on the motor to open the window.

In accordance with other aspects of this particular embodiment, the fire exit system may further include a guide bar, a carriage slidably mounted on the guide bar and attached to a window sash of the window, and a timing belt installed around at least two gears. One of the at least two gears may be mechanically coupled to the motor, and the carriage may be attached to the timing belt.

In accordance with other aspects of this particular embodiment, the carriage may be attached to the window sash using a screw.

In accordance with other aspects of this particular embodiment, the carriage may be attached to the window sash using a removable pin.

In accordance with other aspects of this particular embodiment, the fire exit system may further include a limiting switch coupled to the controller. When the window sash is fully opened, the carriage may activate the limiting switch, and when the limiting switch is activated, the controller is configured to turn off the motor to stop moving the window sash.

In accordance with other aspects of this particular embodiment, the fire exit system may further include a mounting frame. The controller, the switch, the motor, the guide bar, the timing belt, and the limiting switch may be mounted on the mounting frame.

In accordance with other aspects of this particular embodiment, the fire exit system may further include an escape ladder. The escape ladder may be mounted on the mounting frame.

In accordance with other aspects of this particular embodiment, the fire exit system may further include a fire alarm coupled to the switch. The switch may not be activated unless it is enabled. When the fire alarm detects a fire, the fire alarm is configured to enable the switch.

In accordance with other aspects of this particular embodiment, the switch may include a light. The light may flash or strobe when the fire alarm enables the switch.

In accordance with other aspects of this particular embodiment, the fire exit system may further include a power source. The power source may power one or more of the following: the controller, the switch, the fire alarm, and the motor.

In accordance with other aspects of this particular embodiment, the power source may be a battery.

In accordance with other aspects of this particular embodiment, the switch may be wirelessly coupled to the controller.

In accordance with other aspects of this particular embodiment, the fire alarm may be wirelessly coupled to the controller.

In accordance with other aspects of this particular embodiment, the motor may be wirelessly coupled to the controller.

In accordance with other aspects of this particular embodiment, the controller may be programmed to stop the motor after a predetermined amount of time or a predetermined number of revolutions after the motor has been started.

The present disclosure will now be described in more detail with reference to particular embodiments thereof as shown in the accompanying drawings. While the present disclosure is described below with reference to particular embodiments, it should be understood that the present disclosure is not limited thereto. Those of ordinary skill in the art having access to the teachings herein will recognize additional implementations, modifications, and embodiments, as well as other fields of use, which are within the scope of the present disclosure as described herein, and with respect to which the present disclosure may be of significant utility.

BRIEF DESCRIPTION OF THE DRAWINGS

In order to facilitate a fuller understanding of the present disclosure, reference is now made to the accompanying drawings, in which like elements are referenced with like numerals. These drawings should not be construed as limiting the present disclosure, but are intended to be illustrative only.

DETAILED DESCRIPTION OF EMBODIMENTS

Figure 1:
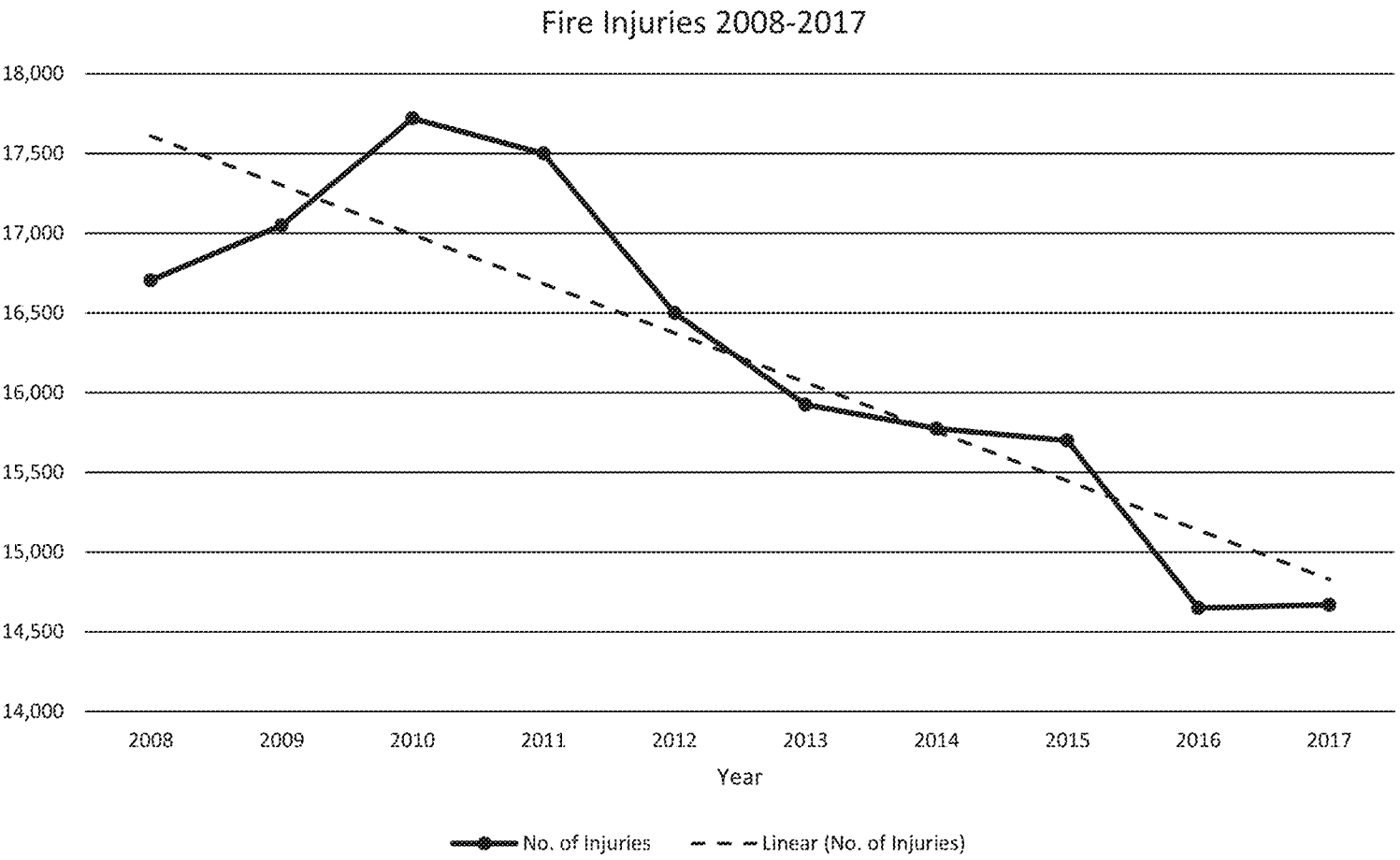
FIG. 1 shows yearly numbers and trend of fire-related injuries from 2008 to 2017 in the United States.
Figure 2:
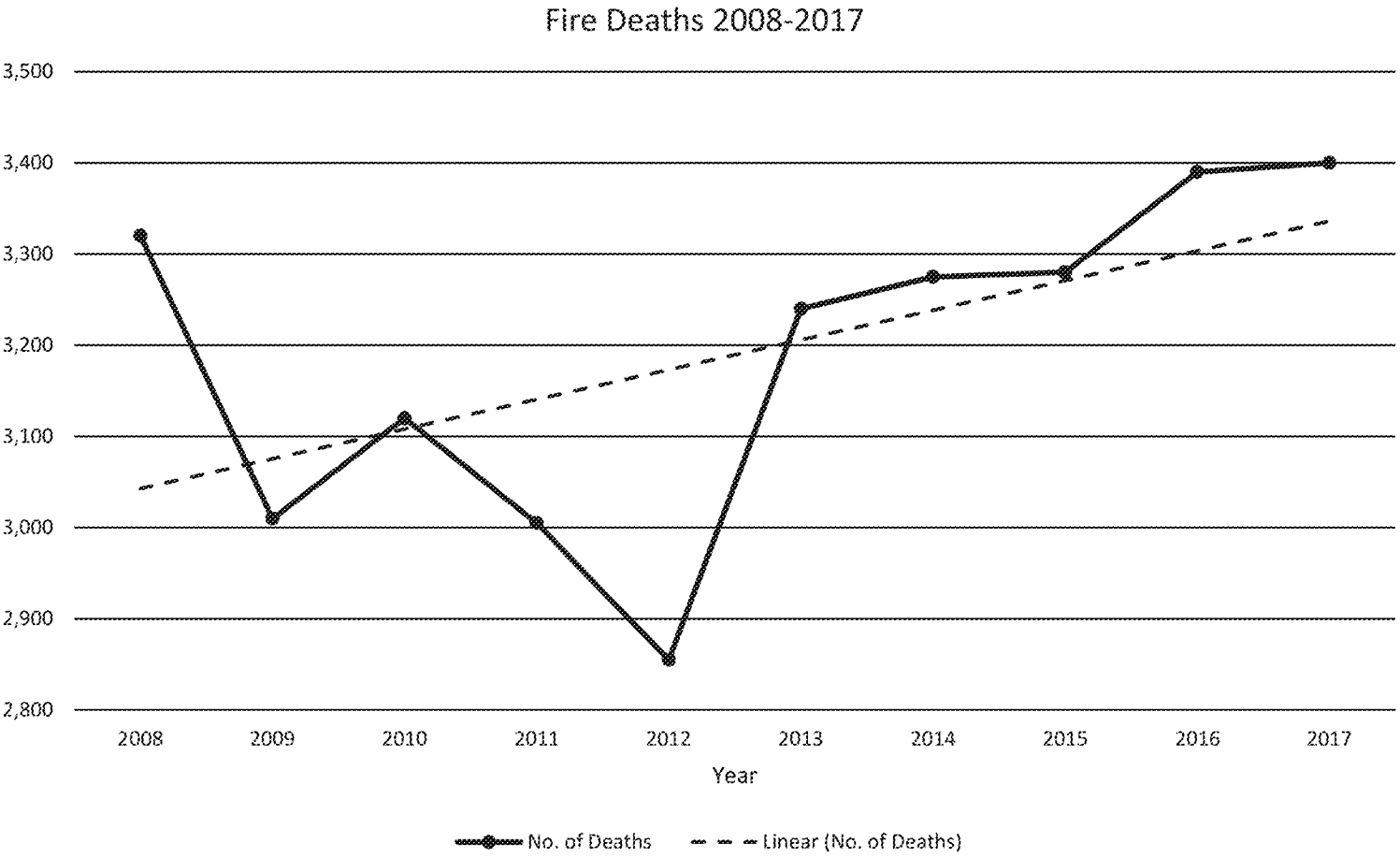
FIG. 2 shows yearly numbers and trend of fire-related deaths from 2008 to 2017 in the United States.
Figure 3:
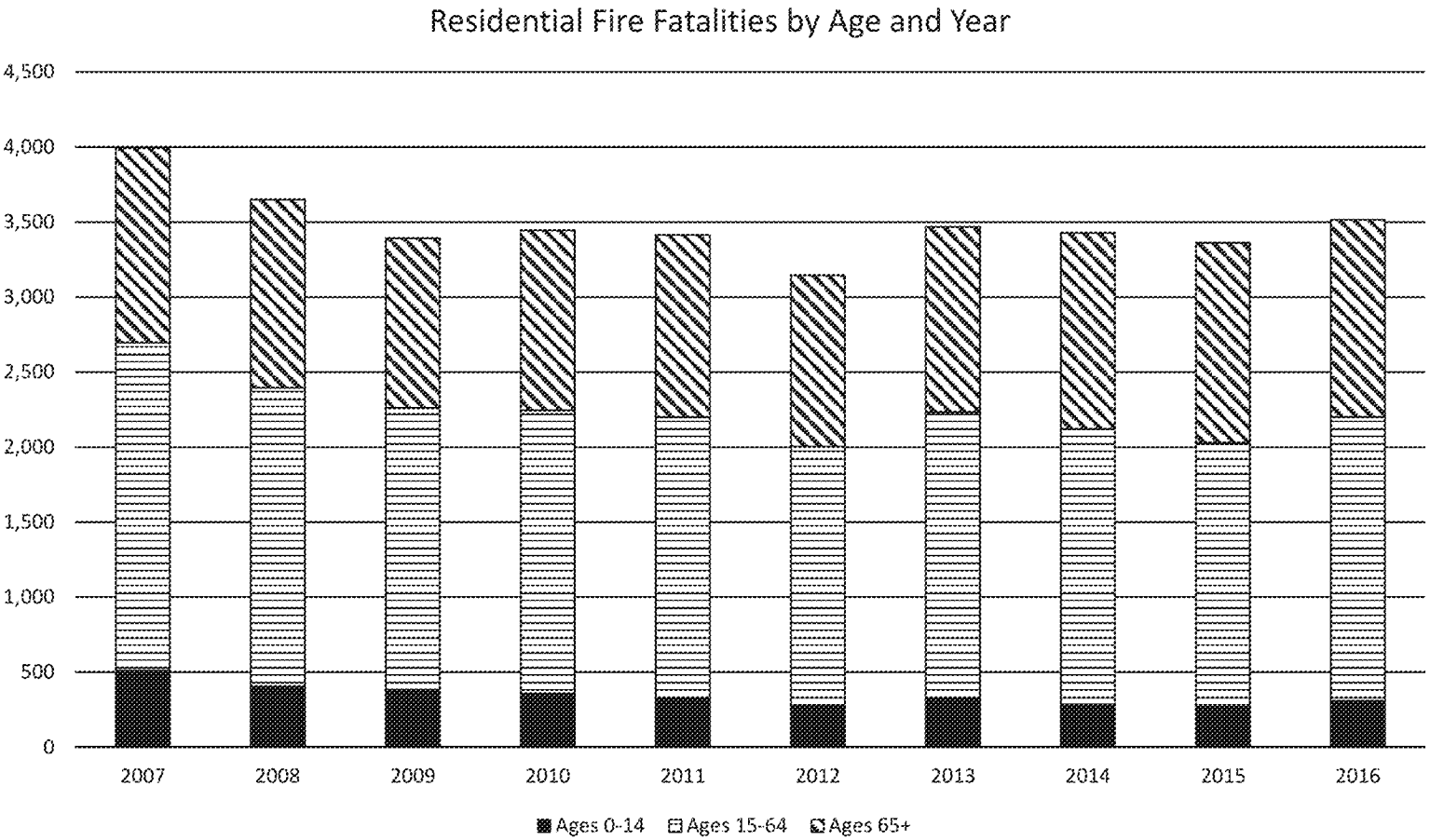
FIG. 3 shows yearly fire-related fatalities by age from 2007 to 2016 in the United States.
Figure 4:
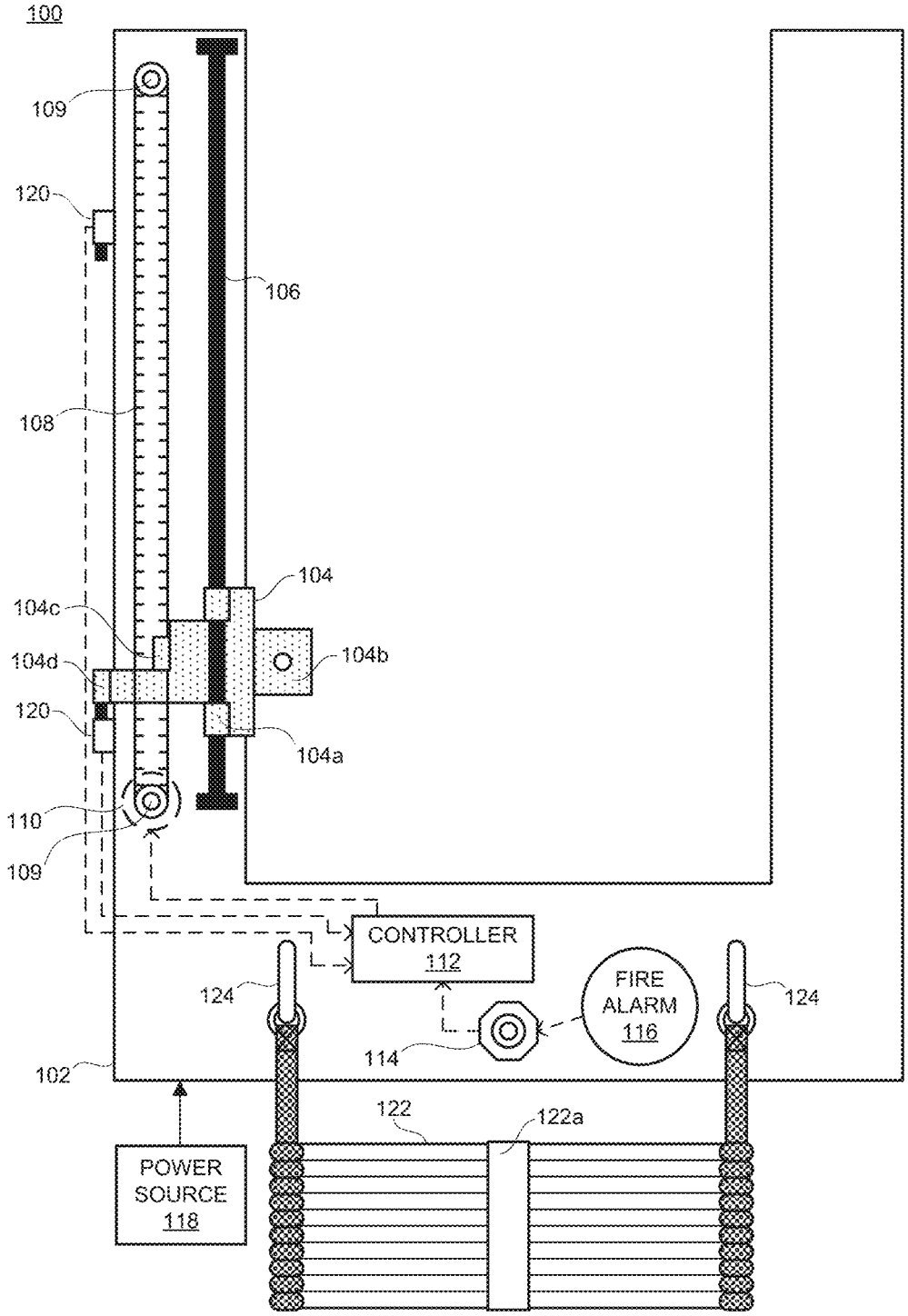
FIG. 4 shows a fire exit system in accordance with an embodiment of the present disclosure.

Referring to FIG. 4, there is shown a fire exit system 100 in accordance with an embodiment of the present disclosure. The fire exit system 100 may include a mounting frame 102 that is configured to be mounted (e.g., using bolts) on a window frame of a window assembly. The mounting frame 102 is illustrated as a U-shape member, which may fit onto a window frame without obstructing window sashes. The mounting frame 102 may be designed in other different shapes and sizes to fit different window assemblies. In some embodiments (e.g., in new building constructions), the mounting frame 102 may be integrated into the window frame or may be the window frame itself.

The fire exit system 100 may include at least one carriage 104, at least one guide bar 106, at least one timing belt 108, and at least one motor 110. The carriage 104 is configured to be attached, at an extended portion 104*b*, to a sliding window sash of the window assembly to which the mounting frame 102 is mounted. The carriage 104 may be slidably installed onto the guide bar 106, which may be securely mounted at its two ends on the mounting frame 102. For example, before being mounted on the mounting frame 102, the guide bar 106 may be fed through hollow portions (e.g., 104*a*) of the carriage 104. Alternatively, portions (e.g., 104*a*) of the carriage 104 may be bent around the guide bar 106 after the guide bar 106 is mounted on the mounting frame 102.

The carriage 104 may be securely attached or hooked (e.g., at 104*c*) to the timing belt 108, which may be installed around at least two gears 109 mounted on the mounting frame 102, as shown in FIG. 4. One of the two gears 109 may be mechanically coupled through the mounting frame 102 to the motor 110, which may be mounted on the back of the mounting frame 102. When the motor 110 runs, it spins the gear 109 to which it is coupled, causing the timing belt 108 to revolve. As the timing belt 108 revolves around the gears 109, it moves the carriage 104 linearly onto the guide bar 106, thereby sliding the window sash to which the carriage 104 is attached.

The fire exit system 100 may further include a controller 112, a switch 114, and a fire alarm 116. The controller 112 may control the motor 110 based on activation of the switch 114. The controller 112 may be electrically (e.g., via wires) or wirelessly (e.g., via Wi-Fi, Bluetooth, etc.) coupled to the motor 110 and the switch 114. The controller 112 may be a microprocessor or microcontroller. When the switch 114 is activated, it may transmit a signal to the controller 112, which in turn may activate the motor 110. To prevent accidental or unintended activation of the switch 114 and to allow the switch to be activated only in case of a fire emergency, the switch 114 may be electrically or wirelessly coupled to the fire alarm 116. As such, the switch 114 may remain disabled or inactive when there is no fire. When the fire alarm 116 detects a fire, the fire alarm 116 may transmit a signal to enable the switch 114. Once enabled, the switch 114 may be activated (e.g., by being depressed or toggled by a person who is trying to escape the fire).

The switch 114 may be in the form of a toggle switch or a push button. Moreover, the switch 114 may include a flashing or strobing light (e.g., a light emitting diode (LED)) that is turned on when the switch 114 is enabled by the signal from the fire alarm 116. The flashing or strobing light may help attract the attention of distressed and disoriented persons in a fire emergency and clearly identify the location of the switch 114 that is to be activated to open the exit window. The switch 114 may be preferably mounted below the window assembly at a height easily accessible by a child or toddler.

The fire exit system 100 may include a power source 118 to power the motor 110, the controller 112, the switch 114, and/or the fire alarm 116. The power source 118 may be power supplied from a conventional wall outlet or a battery pack or both. In some embodiments, power may be supplied by hard wiring the fire exit system 100 to the electrical system of a building. It may be desirable for the fire exit system 100 to include battery power in the event that a fire shuts down the main alternative-current (AC) power supply to the building. In some embodiments, the power source 118 may be distributed among the motor 110, the controller 112, the switch 114, and the fire alarm 116. For example, any one of the motor 110, the controller 112, the switch 114, and the fire alarm 116 may include a separate relative smaller battery source.

The fire exit system 100 may also include at least two limiting switches 120. The limiting switches 120 may be mounted at two ends of the mounting frame 102, as shown in FIG. 4, and may be electrically or wirelessly coupled to the controller 112. The limiting switches 120 may be activated when depressed by an extended portion 104*d* of the carriage 104. When either of the limiting switches 120 is activated, the activated limiting switch 120 may transmit a signal to the controller 112, which in turn may transmit a signal to shut off the motor 110. As the motor 110 runs to slide the carriage 104 on the guide bar 106 (to either open or close a window sash), when the extended portion 104*d* reaches, depresses, and activates one of the limiting switches 120, the activated limiting switch 120 transmits a signal to controller 112, which transmits a signal to shut off the motor 110. As such, the limiting switches 120 ensure that the fire exit system 100 operates a window sash within its slidable range in a window assembly. In some embodiments, the locations of the limiting switches 120 may be adjustable based on the sizes of the window assembly and the window sash. In some embodiments, the limiting switches 120 may be omitted when the controller 112 may be, for example, programmed to stop the motor 110 after a predetermined amount of time or a predetermined number of revolutions after the motor has been started.

The fire exit system 100 may further include a fire escape ladder 122. The fire escape ladder 122 may be attached to the mounting frame 102, for example, at a pair of anchors 124, which are mounted on or part of the mounting frame 102. The fire escape ladder 122 may be a portable fire escape ladder, such as a rolled-up ladder or a ladder with nested rungs, that may be attached to the anchors 124. The fire escape ladder 122 may be kept rolled up or collapsed with its rungs nested via a strap 122*a*. In a fire emergency, once the fire alarm 116 detects a fire, the switch 114 activated, and the window sash opened, the fire escape ladder 122 may be swung through the opened window sash and unrolled or its rungs otherwise deployed by loosening the strap 122*a*, allowing people to go through the window and down the fire escape ladder 122.

The mounting frame 102 is preferably made of a material that is strong enough to withstand the weight of the fire escape ladder 122 along with the maximum foreseeable weight of an adult. For example, the mounting frame 102 may be made from a thick metal sheet. Alternatively, as mentioned above, in new building constructions, the mounting frame 102 may be integrated into the window frame or may be the window frame itself, in which case the building structure surrounding the window frame may provide the necessary support for all the expected weight.

In the above embodiments, the motor 110 may be chosen such that its power rating is high enough to slide open a window sash of a window assembly to which the fire exit system 100 is mounted. The power rating of the motor 110 depends on the weight of the window sash and the desired time for the window sash to fully open. The timing belt 108 may be chosen such that it can withstand the force exerted onto it by the window sash. When the window sash is bulky and heavy, a metal link chain (similar to a bicycle chain) may be used instead of the timing belt 108. On the other hand, if the window sash is light, a plastic or metal bead chain (similar to one in a household roller shade) may be used.

In some embodiments, the motor 110 may be directly coupled to the window sash. For example, the rotor of the motor may include a circular gear and the edge of the window sash may include a linear gear. The teeth of the circular gear may engage with the teeth of the linear gear. In such an embodiment, the fire exit system 100 may not include the carriage 104, the guide bar 106, and timing belt 108.

In some embodiments, the fire alarm 116 may not be mounted on the mounting frame 102. For example, the fire alarm 116 may be any existing fire alarm on the ceiling of a room in a house. Similarly, the fire escape ladder 122 may be mounted on the wall surrounding the window rather than on the mounting frame 102.

Figure 5:
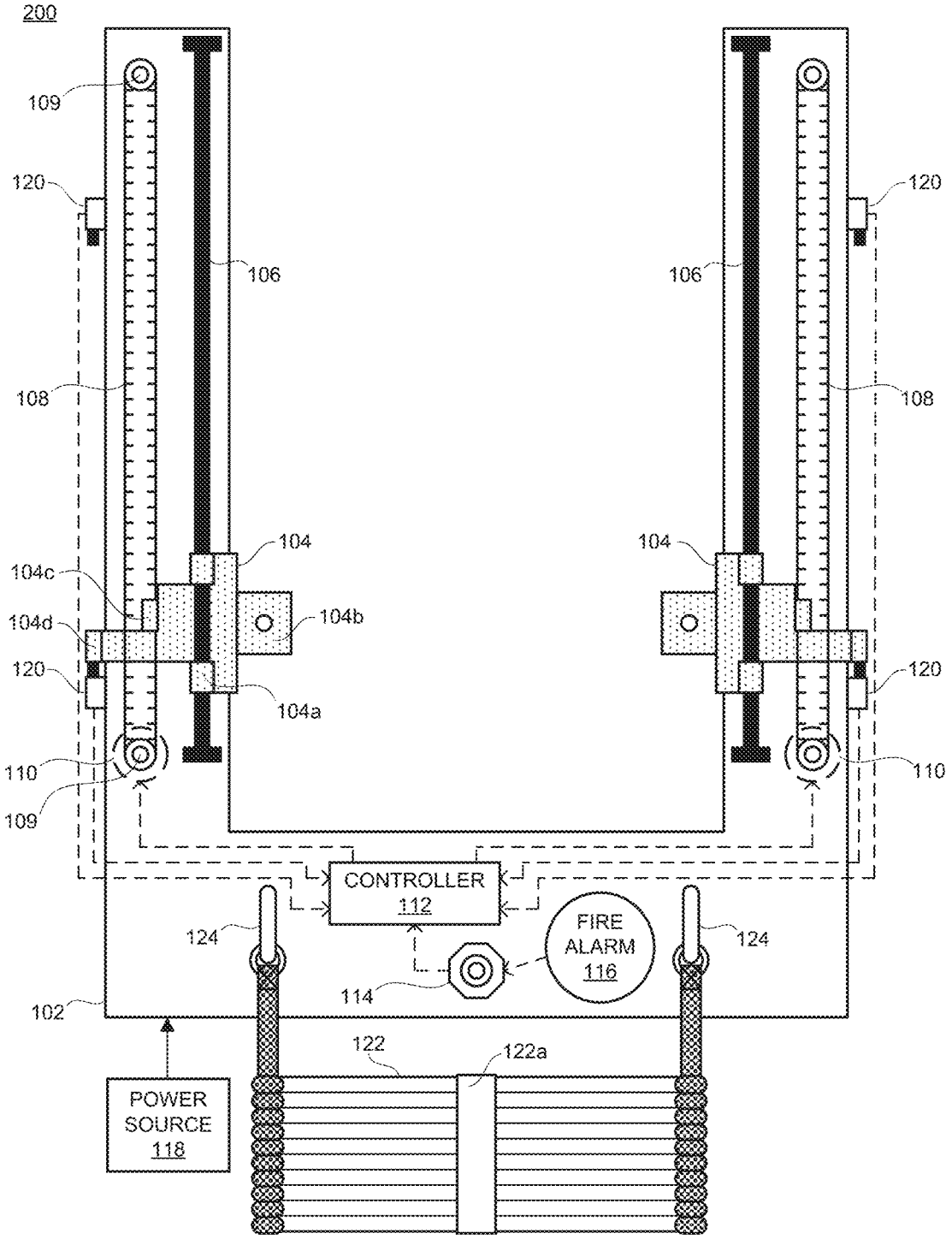
FIG. 5 shows a fire exit system in accordance with an embodiment of the present disclosure.

FIG. 5 shows a fire exit system 200 in accordance with an embodiment of the present disclosure. The fire exit system 200 includes elements with like numerals as those in the fire exit system 100. The fire exit system 200 differs from the fire exit system 100 in that it includes a second set of carriage 104, guide bar 106, timing belt 108, motor 110, and pair of limiting switches 120. For the same window assembly and window sash, the fire exit system 200 may be preferable to the fire exit system 100 because the motors 110 and the time belts 108 may be two times smaller. This is because the motors 110 may each provide half of the total power needed to slide the window sash, and the timing belts 108 may each withstand half the force exerted by the window sash. The fire exit system 200 may provide better control to smoothly open the window sash.

Figure 6:
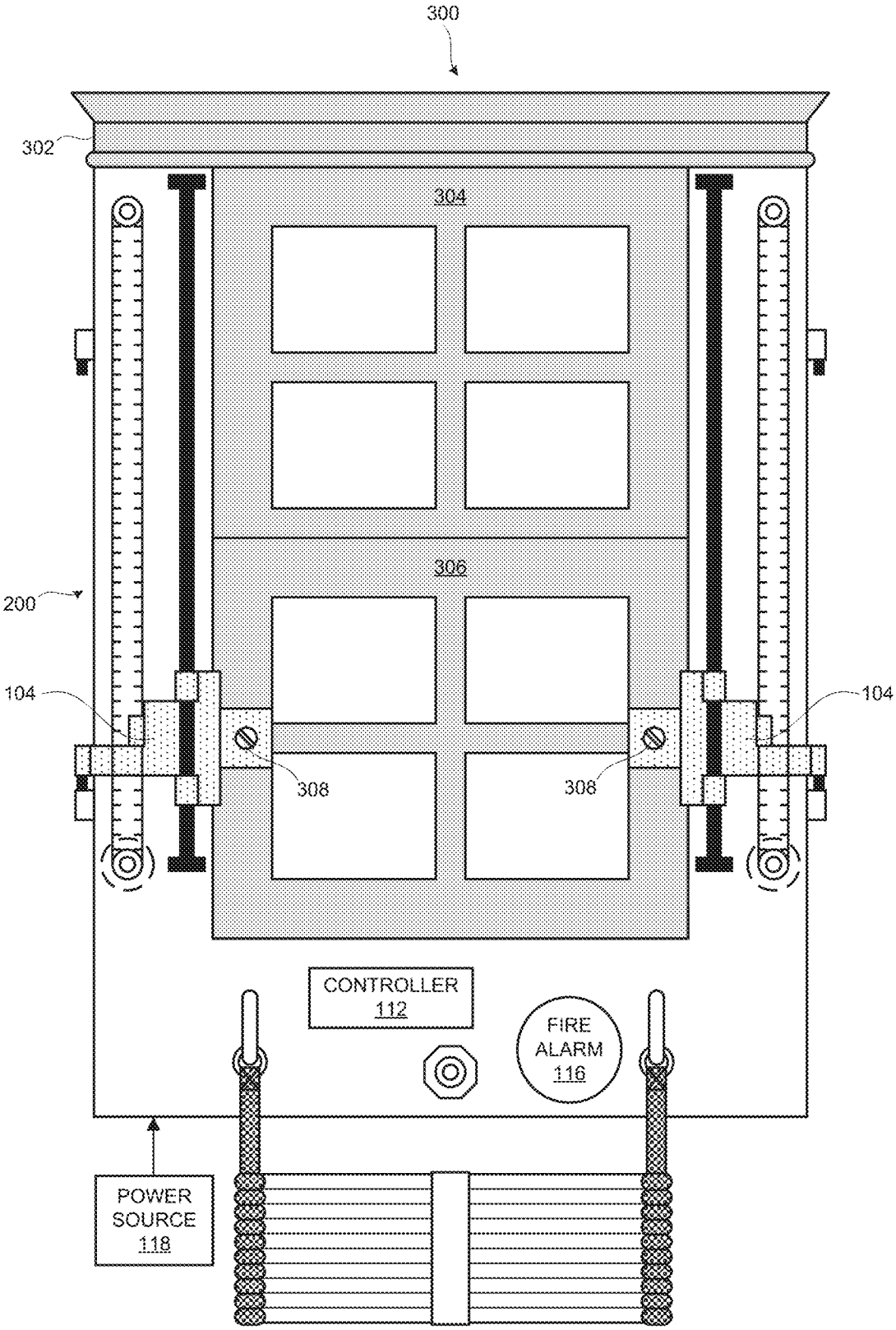
FIG. 6 shows the fire exit system of FIG. 5 mounted on a window assembly, with a window sash closed, in accordance with an embodiment of the present disclosure.

FIG. 6 shows the fire exit system 200 mounted on a window assembly 300, in accordance with an embodiment of the present disclosure. The window assembly 300 may include a window frame 302, a fixed window sash 304, and slidable window sash 306. FIG. 6 illustrates the slidable window sash 306 in its closed position. The fire exit system 200 is mounted on the window frame 302. The carriages 104 of the fire exit system 200 may be attached to the slidable window sash 306 with a pair of screws 308. Alternatively, attachments that are less permanent than the screws 308 (e.g., cotterless hitch pins) may be used such that they may be easily removed when and if the window sash 306 needs to be opened in non-emergency situations.

Figure 7:
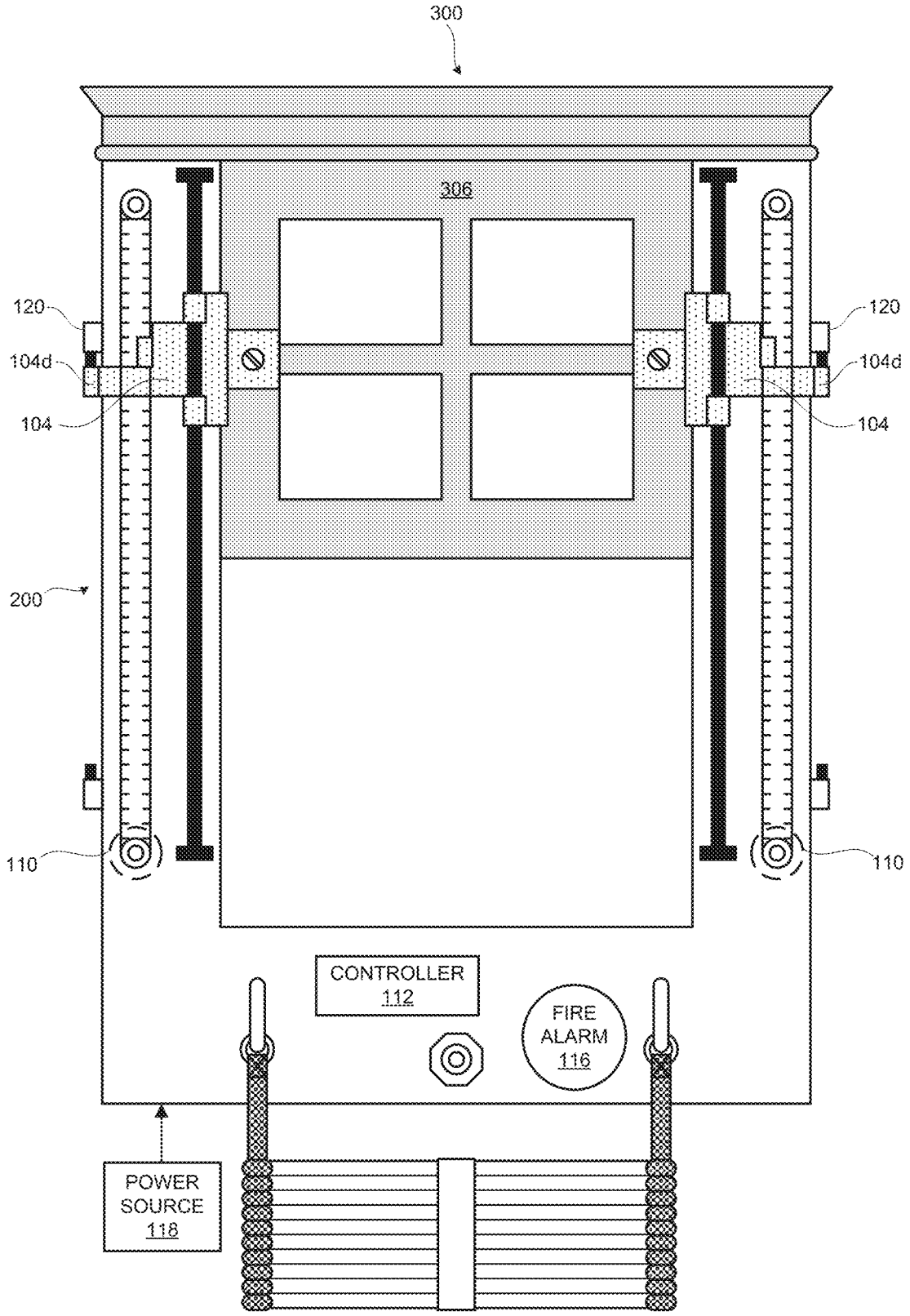
FIG. 7 shows the fire exit system of FIG. 5 mounted on a window assembly, with a window sash opened, in accordance with an embodiment of the present disclosure.

FIG. 7 illustrates the fire exit system of 200 mounted on the window assembly 300, with a window sash 306 in its opened position, in accordance with an embodiment of the present disclosure. As can be seen in FIG. 7, when the window sash 306 is fully opened, the end portions 104*d* of the carriages 104 are in contact with the upper limiting switches 120. This indicates that these limiting switches 120 have transmitted a signal to the controller 112, which in turn has transmitted control signals to shut down the motors 110.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Further, although the present disclosure has been described herein in the context of at least one particular implementation in at least one particular environment for at least one particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein.

The invention claimed is:

1. A fire exit system comprising:

a guide bar;

a carriage slidably mounted on the guide bar and attached to a sash of a window;

a motor mechanically coupled to the carriage;

a controller coupled to the motor;

a switch coupled to the controller, a limiting switch coupled to the controller; and a fire alarm coupled to the switch, wherein the switch is inoperative unless the switch is enabled by the fire alarm;

when the fire alarm detects a fire, the fire alarm enables the switch such that the switch is operative;

when the switch is operative and activated, the controller turns on the motor to open the sash; and when the carriage activates the limiting switch, the controller turns off the motor to stop moving the sash.

2. The fire exit system of claim 1, further comprising:

a timing belt installed around at least two gears, wherein one of the at least two gears is mechanically coupled to the motor, and the carriage is attached to the timing belt.

3. The fire exit system of claim 2, further comprising:

a mounting frame, wherein the controller, the switch, the motor, the guide bar, and the at least two gears are mounted on the mounting frame.

4. The fire exit system of claim 3, further comprising:

an escape ladder attached to the mounting frame.

5. The fire exit system of claim 1, wherein the carriage is attached to the sash using a screw.

6. The fire exit system of claim 1, wherein the carriage is attached to the sash using a removable pin.

7. The fire exit system of claim 1, wherein the carriage activates the limiting switch when the sash is fully opened.

8. The fire exit system of claim 1, wherein the limiting switch is wirelessly coupled to the controller.

9. The fire exit system of claim 1, further comprising:

a mounting frame, wherein the controller, the switch, the motor, the guide bar, and the limiting switch are mounted on the mounting frame.

10. The fire exit system of claim 9, further comprising:

an escape ladder attached to the mounting frame.

11. The fire exit system of claim 1, further comprising:

a mounting frame, wherein the controller, the switch, and the motor are mounted on the mounting frame; and an escape ladder mounted on the mounting frame.

12. The fire exit system of claim 1, further comprising:

a power source for powering one or more of the following: the controller, the switch, the fire alarm, and the motor.

13. The fire exit system of claim 12, wherein the power source is a battery.

14. The fire exit system of claim 1, wherein the switch includes a light, wherein the light flashes or strobes when the fire alarm enables the switch.

15. The fire exit system of claim 1, wherein the fire alarm is wirelessly coupled to the switch.

16. The fire exit system of claim 1, wherein the switch is wirelessly coupled to the controller.

17. The fire exit system of claim 1, wherein the motor is wirelessly coupled to the controller.

18. The fire exit system of claim 1, wherein, after the motor is turned on, the controller stops the motor after a predetermined amount of time or a predetermined number of revolutions.

* * * * *